US011858704B2

(12) United States Patent
Tabone

(10) Patent No.: US 11,858,704 B2
(45) Date of Patent: Jan. 2, 2024

(54) CONTAINER BASE AND LID WITH PLANAR AREA FOR FLAT APPLICATION OF ADHESIVE MEMBRANE

(71) Applicant: Maurice Joseph Paul Tabone, Moorebank (AU)

(72) Inventor: Maurice Joseph Paul Tabone, Moorebank (AU)

( * ) Notice: Subject to any disclaimer, the term of this patent is extended or adjusted under 35 U.S.C. 154(b) by 59 days.

(21) Appl. No.: 17/577,552

(22) Filed: Jan. 18, 2022

(65) Prior Publication Data

US 2022/0135298 A1 May 5, 2022

Related U.S. Application Data

(63) Continuation of application No. 16/360,964, filed on Mar. 21, 2019, now Pat. No. 11,225,365, which is a continuation of application No. 15/656,623, filed on Jul. 21, 2017, now Pat. No. 10,287,070, which is a continuation of application No. 12/449,556, filed as application No. PCT/AU2008/000173 on Feb. 12, 2008, now abandoned.

(30) Foreign Application Priority Data

Feb. 12, 2007 (AU) ..... 2007900654
Apr. 30, 2007 (AU) ..... 2007902246

(51) Int. Cl.
*B65D 55/06* (2006.01)
*B65D 43/16* (2006.01)
*B65D 43/02* (2006.01)

(52) U.S. Cl.
CPC ..... *B65D 55/06* (2013.01); *B65D 43/0202* (2013.01); *B65D 43/161* (2013.01); *B65D 43/162* (2013.01); *B65D 2203/02* (2013.01)

(58) Field of Classification Search
CPC .. B65D 55/0818; B65D 55/06; B65D 43/162; B65D 43/163; B65D 43/161; B65D 2251/1016; B65D 25/36; B65D 77/36; B65D 2102/0007; B65D 2401/05; B65D 2203/00; B65D 51/245; B65D 25/205
See application file for complete search history.

(56) References Cited

U.S. PATENT DOCUMENTS 3,344,974 A * 10/1967 Bostrom ..... B65D 51/185 D9/425
3,556,337 A * 1/1971 Harmon ..... B65D 43/162 220/315
5,096,084 A * 3/1992 Wells ..... B65D 43/164 220/326

* cited by examiner

*Primary Examiner* — Andrew T Kirsch
(74) *Attorney, Agent, or Firm* — Niro McAndrews, LLP

(57) ABSTRACT

The embodiments provide a container of the type to hold fresh food or produce. Container has a base and a lid moveable with respect to the base between an open position and a closed position. The lid has a planar area. The base has a second planar area. In the closed position, the first planar and the second planar area include a substantially flat area suitable for receipt of an adhesive membrane, such as a self-adhesive label. The substantially flat area includes an edge of the first planar area and at least part of the second planar area.

31 Claims, 7 Drawing Sheets

CONTAINER BASE AND LID WITH PLANAR AREA FOR FLAT APPLICATION OF ADHESIVE MEMBRANE

RELATED APPLICATIONS

This application is a continuation of U.S. patent application Ser. No. 16/360,964 that was filed Mar. 21, 2019 and issued Jan. 18, 2022 as U.S. Pat. No. 11,225,365, which is a continuation of U.S. patent application Ser. No. 15/656,623 filed Jul. 21, 2017 that issued as U.S. Pat. No. 10,287,070, which is a continuation of U.S. patent application Ser. No. 12/449,556, filed Aug. 12, 2009, now abandoned, which is a U.S. National Phase entry under 35 U.S.C. § 371 of International Application No. PCT/AU2008/000173, filed Feb. 12, 2008, which claims the benefit under 35 U.S.C. § 119(a) of Australian Application No. 2007902246, filed Apr. 30, 2007, and Australian Application No. 2007900654, filed Feb. 12, 2007, the contents of which are all herein incorporated by reference.

TECHNICAL FIELD

This disclosure relates to containers. In particular, this disclosure relates to containers intended to hold fresh food or produce, although the scope is not limited to this area. The disclosure is especially concerned with containers in a form which can facilitate application of labels, such as tamper evident labels.

Priority is claimed of Australian Patent Application Nos 2007900654 and 2007902246, the contents of the specifications of which are incorporated herein by reference.

BACKGROUND

Thermoformed containers suitable for holding fresh food or produce are in common use. Traditionally, these have consisted of a base with a lid, the lid being hinged to the base or separate therefrom. In order to secure the lid to the base, these known containers require one or more labels to be adhered to both the lid and the base in a "wrap around" fashion. In high output operations, there is a problem in applying a "wrap around" (non-flat) label because automated equipment is generally designed for flat label application.

In addition, labels applied to containers of this type often carry a barcode, usually along with other information. There can be problems in scanning barcodes on non-flat labels. Consequently, from this point of view, a flat label would be preferred.

It is an object of the present embodiments, at least in some embodiments, to provide a container configuration which permits flat application of labels.

More recently, a dual hinged lid container has been devised. Reference is made to Australian patent No 2003234951. The specification of this patent discloses a container having a lid provided in two parts, each part being hinged to the base. When both lids are closed, there is available a generally flat area across the lid edges in the center of the container top to permit a flat label to be applied. The flat label so applied can act as a tamper evident seal.

While this prior art dual hinged lidded container can work admirably in many applications, there are instances where it is undesirable to apply a label across a join in the center of a container lid in this manner. For example, the label may obstruct a consumer's view of contents of the container, especially where there is a relatively high label-to-lid area ratio. As another example, on larger containers, a regular sized label may prove inadequate to give a tamper evident seal. If the size of the label were to be increased, this would add to label cost and may prove uneconomical. In other instances, it may be desirable to provide a container with increased security.

It is an object of the present embodiments, at least in some embodiments, to alleviate some or all of these concerns or, at the least, to provide a useful alternative which is appropriate for containers of different shapes and sizes.

DISCLOSURE

Accordingly, the present embodiment provides a container having a base and a lid moveable with respect to the base between an open position and a closed position, the lid having a first planar area and the base having a second planar area, wherein, in the closed position, the first and second planar areas include a substantially flat area suitable for receipt of an adhesive membrane, the substantially flat area including an edge of the first planar area and at least part of the second planar area.

The container may be made of any suitable material but preferably is a thermoformed, relatively thin plastic material, as is presently known in the art. Examples of suitable thermoformable plastic material are polyvinyl chloride (PVC), polyethylene terephthalate (PET), polypropylene, polylactide (PLA) and biaxially oriented polystyrene (BOPS). The container may be of any desirable shape. Currently, most popular containers of this type are square or rectangular in cross section and these are encompassed by the present embodiments, along with other shapes.

The base preferably includes a floor and upwardly extending side walls. Preferably, all or at least one of the side walls end at a rim which, in some embodiments, may include the second planar area. If desired, the rim may include means for supporting the container during the selling process. For example, the rim may include a hang sell hole for "off"-shelf display.

The lid or the base may include ventilation holes, ribs or arches or any other modifications suited to intended contents and/or conditions of sale.

The base and upstanding side walls may define an opening which, in use, is horizontal. However, other variations are possible. For example, the base may define an opening which, in use, is vertical and intended to be closed by a lid in a vertical orientation in use.

The lid is moveable with respect to the base between an open position and a closed position. The lid may be hinged or otherwise attached to the base in any suitable manner. Alternately, the lid may be separate from the base, in which case it may be desirable to have two or more first planar areas on the lid and correspondingly two or more second planar areas on the base if tamper evidence is required.

The lid may be generally flat or it may include shaped portions (such as one or more domes, ribs or arches) in addition to the first planar area. Optionally, the lid may include one or more recessed portions which may be useful for storing items which a consumer may require once the container has been opened. Such items may include cutlery, dressings and condiments.

The lid may be of known type, for example an "inside fitting" or an "outside fitting" lid in relation to the base when closed.

The lid may be a single lid or may be a multi-part lid. For example, the embodiments are applicable to the type of dual-lidded container in Australian patent No. 2003234951.

An embodiment is shown in the drawings, below. The lid may have more than two parts.

The lid and/or the base may include any suitable mechanical locking mechanisms, such as one or more projections, each receivable in a recess with an interference-type fit. These may be located on surfaces which, in use, are horizontal or vertical, for example. Another example of a locking mechanism is a channel style lock.

The first planar area is on the lid and preferably is greater than 5 cm2. The first planar area is preferably located adjacent an edge of the lid since, when a label or other adhesive membrane is applied, at least part of the purpose is to secure the lid to the base. In a preferred embodiment, the first planar area is located opposite a hinged edge of the lid, when the lid is hinged to be base. However, it is to be understood that the embodiments are not limited to this. The first planar area may be located adjacent any edge of the lid or in any other desired location. For example, the first planar area may be located on a side of the lid (approximately vertical in use.)

The first planar area may be generally parallel to a floor in the base. However, other configurations are possible. For example, the first planar area may be disposed at an angle to some or all of the remainder of the lid. An example is illustrated in the drawings, below.

The second planar area is on the base. This may take any suitable form and many variations are possible. By way of example, the second planar area may be located on a rim for the base or on an extension thereof, optionally inclined at an angle to the rim. The lid may be contoured for a snug fit with the second planar area.

The substantially flat area suitable for receipt of an adhesive membrane includes an edge of the first planar area and at least part of the second planar area. It is intended, or course, that the adhesive membrane (preferably an adhesive label) may be applied to the substantially flat area, connecting the lid and the base in the area of the edge of the first planar area included in the substantially flat area. The first and second planar areas may be adjacent or they may partially overlap. In one view, they may be regarded as generally coplanar, although, strictly speaking, where there is a simple overlap there will be a small step from the first planar area to the second planar area.

The edge of the first planar area may simply abut at least part of the second planar area. In another embodiment, the edge of the first planar area may form a chamfered abutment with at least part of the second planar area. In yet another embodiment, an edge of the first planar area surrounds the second planar area.

The substantially flat area is preferably located at an opposite side of the container to the hinge, or opposite each hinge when there is more than one. However, the embodiments are not limited to this configuration.

It will be appreciated that when the lid is in the closed position, the substantially flat area is preferably suitable for application of an adhesive membrane, such as a self-adhesive label applied by an automated applicator in a generally flat fashion.

While the adhesive membrane is preferably a self-adhesive label, it may also take other forms. For example, it may be a heat sealable lidding film of plastic, foil or other sheet material.

If desired, the adhesive membrane may have a perforation or other area of weakness locatable at or adjacent the edge of the first planar area within the substantially flat area. The purpose of this is to simplify opening of the container by the consumer.

If there are two or more first planar areas and second planar areas, the adhesive membrane may be applied to all of these, or some of these, or to one first planar area and one second planar area only.

If desired, the container of the embodiments may be designed so as to be nestable or stackable with identical or similar containers.

BRIEF DESCRIPTION OF THE DRAWINGS

The embodiments will now be described in relation to certain non-limiting examples thereof in the accompanying drawings, in which.

DETAILED DESCRIPTION OF THE DRAWINGS

Figure 1:
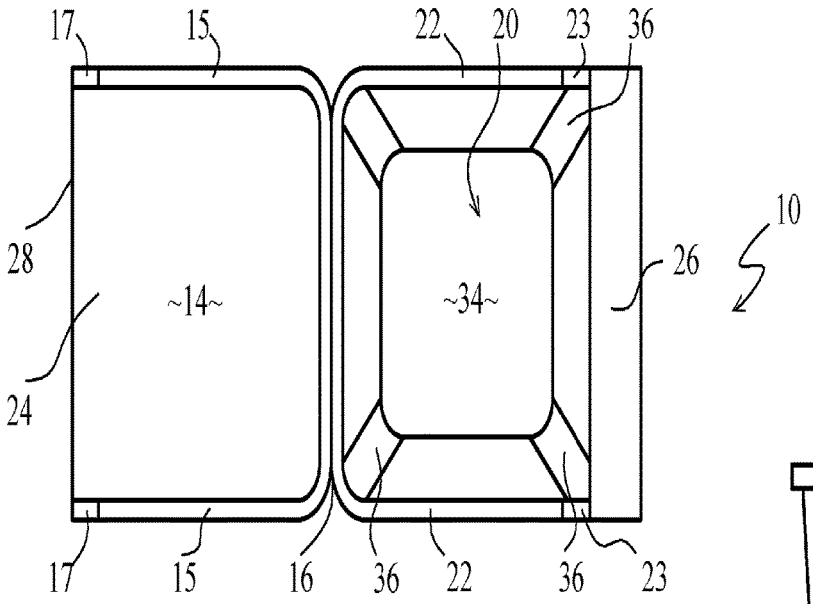
FIG. 1 is a plan view of a first embodiment of container, showing a lid, hinged to the base in the open position.
Figure 3:
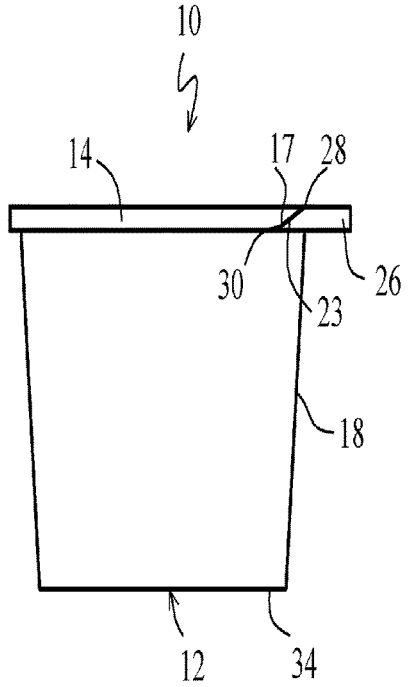
FIG. 3 is a side elevation of the embodiment of FIGS. 1 and 2, with the lid in the closed position.
Figure 2:
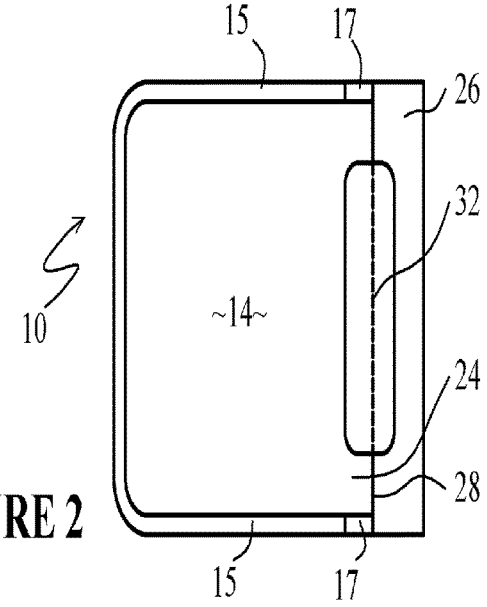
FIG. 2 corresponds to the embodiment in FIG. 1, but showing the lid in the closed position.
Figure 5:
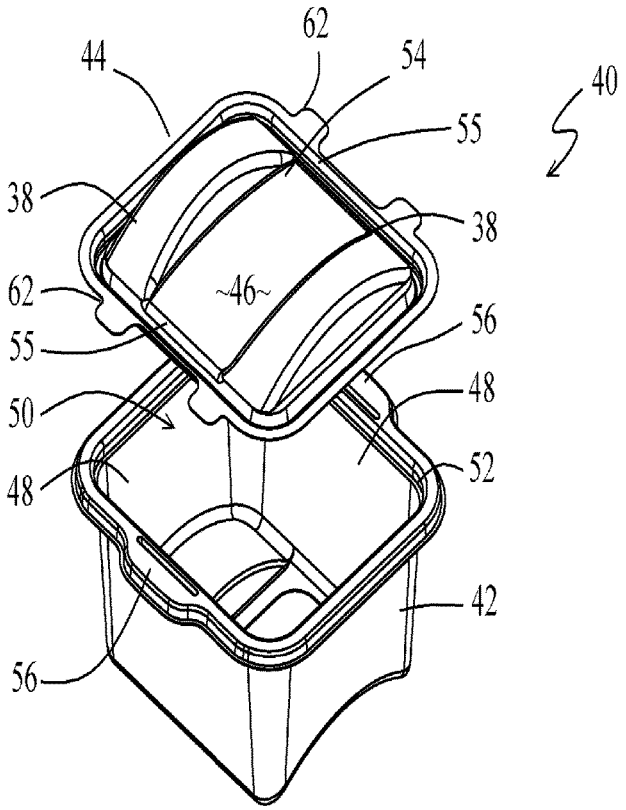
FIG. 5 is an exploded view of the embodiment in FIG. 4.
Figure 4:
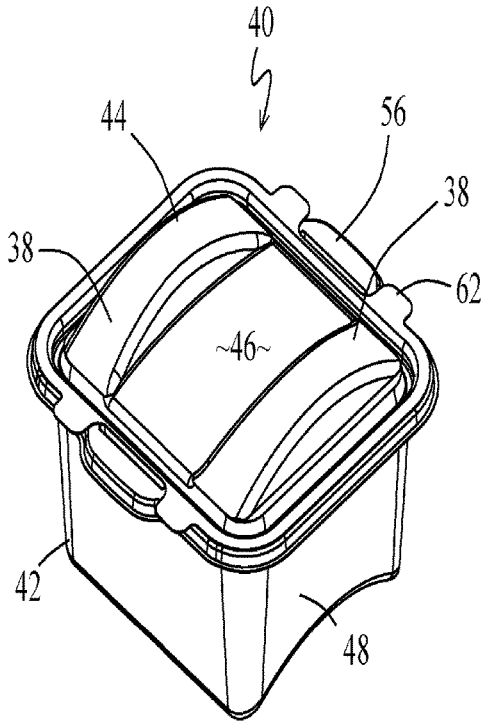
FIG. 4 is a perspective view of a second embodiment of container, having a lid separate from the base.
Figure 7:
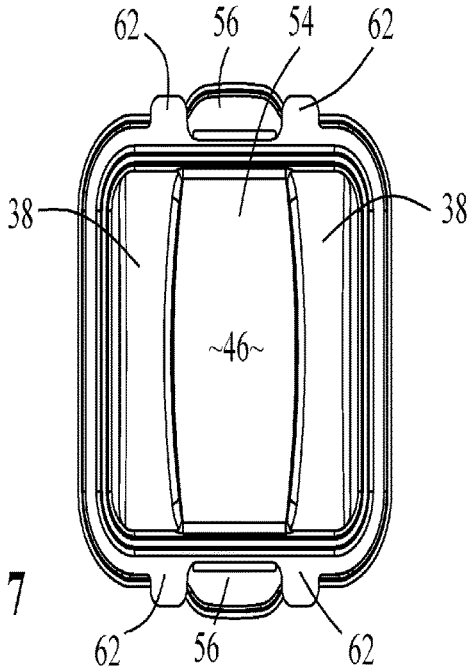
FIG. 7 is a top plan view of the embodiment of FIG. 4.

Referring first to FIGS. 1, 2 and 3, the first embodiment of the container, designated generally as 10, has a base 12 and a lid 14, hinged to base 12 at hinge 16. Rims 15 have ramp portions 17.

Base 12 has upwardly extending sidewalls 18 defining an opening 20 through which products are inserted into container 10 before lid 14 is closed. At the top end of walls 18 of base 12 are rims 22 (refer FIG. 1), each of which has a ramp portion 23.

Lid 14 in this embodiment has a first planar area 24 which, in this embodiment, comprises virtually the whole of lid 14. The second planar area is formed by rim portion 26 which, as can be seen in FIG. 1, is wider than rims 22. Ramp portion 23 is inclined upwardly from rim 22 to rim 26.

In the closed position, illustrated in FIG. 2, first planar area 24 has mated with second planar area—rim 26—to form a substantially flat area in which edge 28 of lid 14 has mated with rim 26 of base 12, chamfer 30 being formed between them, using ramp portion 23. Adhesive label 32 is shown in place in FIG. 2.

As can be seen in FIG. 1, sidewalls 18 of base 12 are tapered towards floor 34, corners 36 being rounded as illustrated. Margin 15 on lid 14 can include locking means to lock lid 14 to base 12 via rims 22.

Turning now to the second embodiment illustrated in FIGS. 4 to 9, the container, designated generally as 40, has a base 42 and a separate lid 44, with upwardly extending side walls 48 defining an opening 50 through which product may be inserted before lid 44 is closed. Base 42 has a rim 52 with a pair of enlarged portions 56, comprising in this embodiment second planar areas.

Lid 44 has a first planar area 54 defined by ribs 38 and edges 55.

A single label (not shown) can extend over the whole of first planar area 54 and both second planar areas 56. Alternately, two separate labels may be used, the first covering part of first planar area 54 and one of the adjacent second planar areas 56, while the over covers part of first planar area 54 and the adjacent second planar area 56, leaving free central portion 46 of lid 44.

Figure 6:
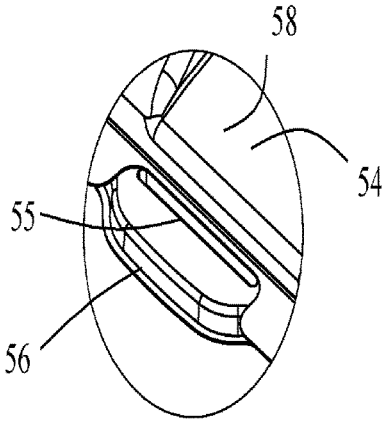
FIG. 6 is a detail of the circled portion of FIG. 4.

As shown in FIG. 6, each of second planar areas 56 may include an aperture or recess 58. A sharp object may be inserted through a label (not shown) covering first planar area 54, second planar area 56 and aperture 58, to tear the label through aperture 58, to assist in removing lid 44 from base 42.

In this embodiment, lid 44 also includes removal tabs 62, to assist in removing lid 44 from base 42.

Figure 8:
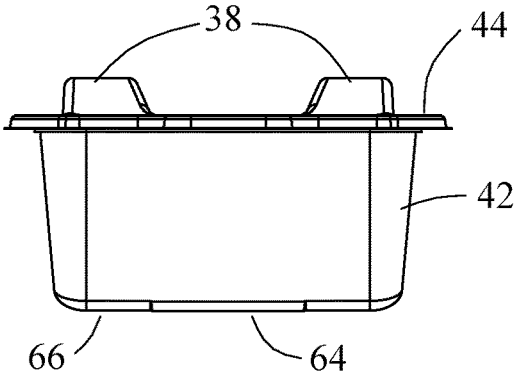
FIG. 8 is a front elevation of the embodiment of FIG. 4.
Figure 9:
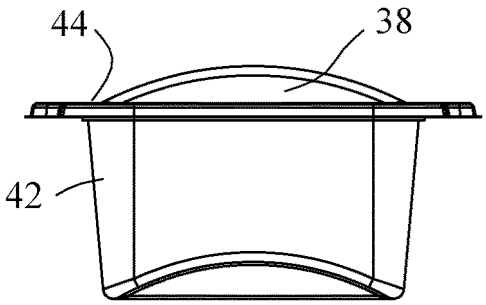
FIG. 9 is a side elevation of the embodiment of FIG. 4.

Container 40 may include vents (not shown) and depression 64 in floor 66 of base 42, as desired (refer FIG. 8). Container 40 may also include one or more recessed portions in lid 44. These may be included in central portion 46 or in another desired location. It is preferred that any such recessed portion is sealed by a label.

Figure 10:
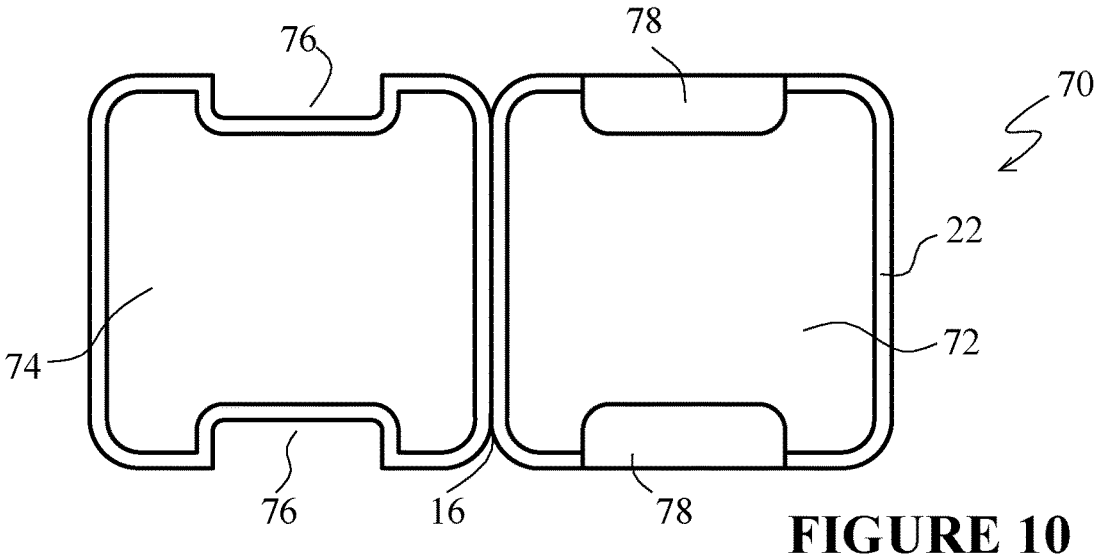
FIG. 10 is a top plan view of a further embodiment in the open position.
Figure 11:
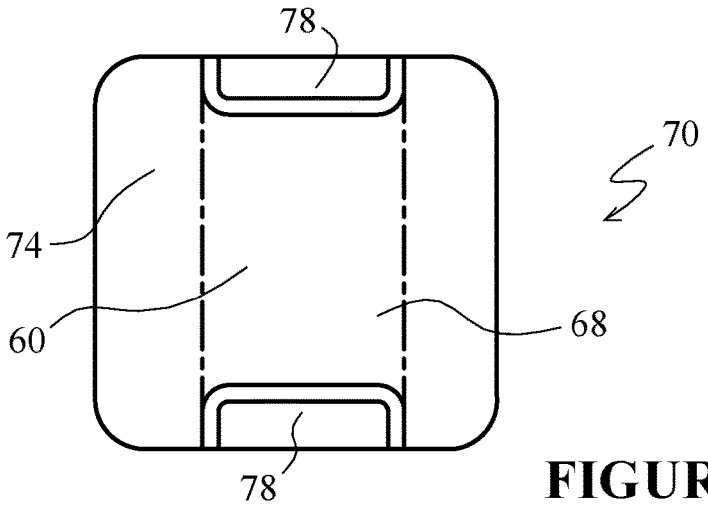
FIG. 11 is a top plan view of the embodiment of FIG. 10, showing the lid in the closed position.

A third embodiment is shown in FIGS. 10 and 11, where container 70 has base 72 hinged to lid 74 at 16. Lid 74 is cut away at 76 and base 72 has flat portions 78. As can be seen in FIG. 11, when lid 74 is closed on base 72, cut aways 76 leave flat portions 78 exposed. When a label 60, shown in dotted outline in FIG. 11, is placed over first planar area 68 of lid 74 and over flat portion 78 (second planar areas) of base 72, lid 74 is effectively sealed to base 72. Flat portions 78 stand proud of rim 22, so that when exposed by cut-outs 76 of lid 74, first planar area 68 is substantially co-planar with flat portions 78.

Figure 12:
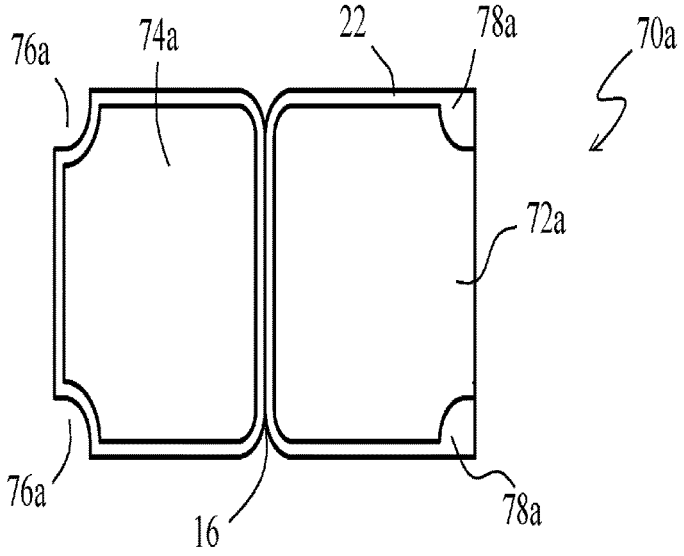
FIG. 12 is a top plan view of a further embodiment in the open position.
Figure 13:
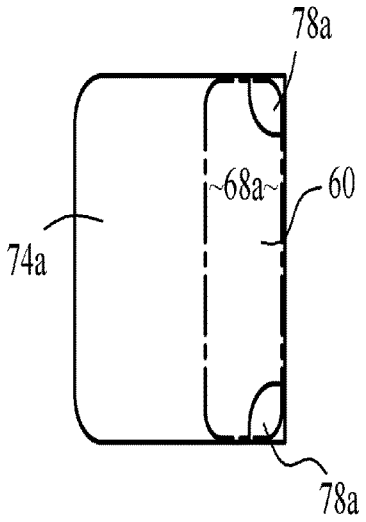
FIG. 13 is a top plan view of the embodiment of FIG. 12 in the closed position.

The next embodiment in FIGS. 12 and 13 is similar to that in FIGS. 10 and 11 and the same numbers have been used to indicate the same or similar parts, with the addition of the letter "a". Whereas in the FIGS. 10 and 11 embodiment the cut-away portions 76 on lid 74 were centered in an edge of lid 74, in the FIGS. 12 and 13 embodiment cut-away portions **76*a* are located in two opposite corners of lid 74*a***.

Similarly, flat portions **78*a* are located at corners of base 72*a***.

As was the case with the previous embodiment, when lid **74*a* is closed on base 72*a*, flat portions 78*a* are substantially co-planar with first planar area 68*a***.

Figure 14:
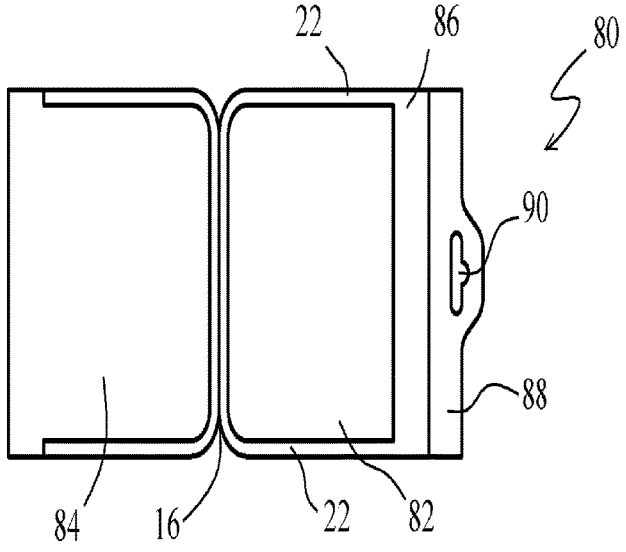
FIG. 14 is a top plan view of a further embodiment in the open position.
Figure 15:
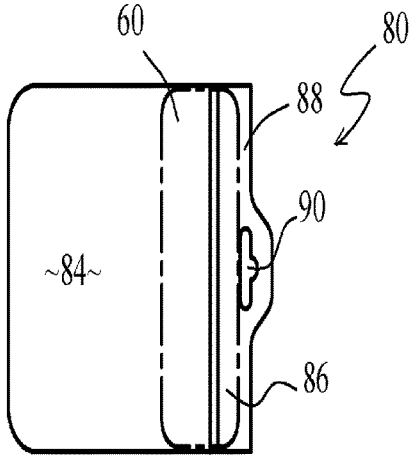
FIG. 15 is a top plan view of the embodiment of FIG. 14 in the closed position.

The next embodiment shown in FIGS. 14 and 15 shows container 80 having base 82 and lid 84. Base 82 has narrow rims 22 and expanded rim 86. Expanded rim 86 includes further portion 88 with hang sell hole 90, to enable container 80 to be displayed on a hanger.

Expanded rim 86 is designed so that, when lid 84 is closed on container 82, expanded rim 86 is substantially co-planar with lid 84, which in this embodiment comprises the first planar area.

As can be seen in FIG. 15, label 60 can be affixed to cover the right-hand side of lid 84 and expanded rim 86.

Figure 16:
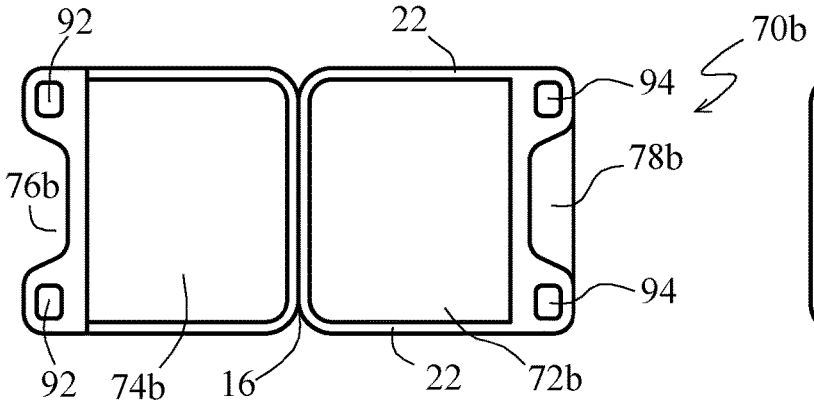
FIG. 16 is a top plan view of a further embodiment in the open position.
Figure 17:
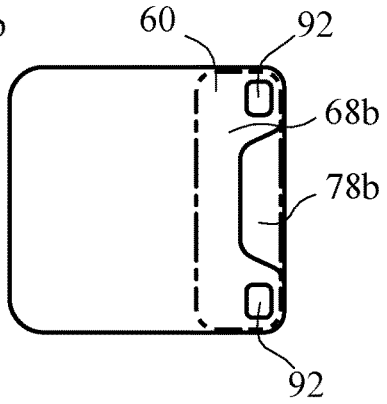
FIG. 17 is a top plan view of the embodiment of FIG. 16 in the closed position.

The embodiment in FIGS. 16 and 17 is similar to that shown in FIGS. 10 and 11 and 12 and 13. The same labels will be used to designate the same or similar parts, with the addition of the letter "b".

Container **70*b* has base 72*b* and lid 74*b*, hinged at 16. Cut-away 76*b* on lid 74*b* is designed to expose flat portion 78*b* on base 72*b* in the closed position (FIG. 17). Flat portion 78*b* stands proud of rim 22 so that first planar area 68*b* is substantially co-planar with flat portion 78*b***.

This embodiment includes lock lugs 92 designed for a friction fit into lock recesses 94 on base **72*b*. As can be seen from FIG. 17, when label 60 is affixed, it covers not only first planar area 68*b* and flat portion 78*b* but also lock lugs 92**.

The embodiments in FIGS. 18 to 21 illustrate how the first and second planar areas may be disposed at an angle to the lid and to a rim on the base.

Figure 18:
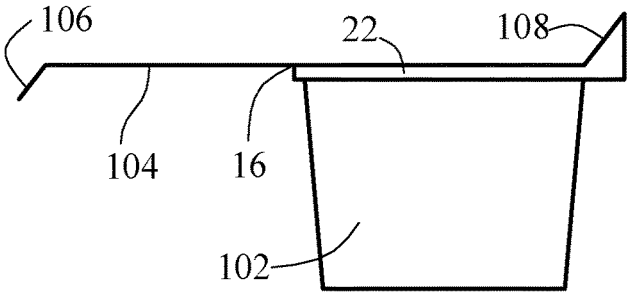
FIG. 18 is a side elevation of a further embodiment, where the first and second planar areas are at an angle to the base and lid, the lid being in the open position in this Figure.
Figure 19:
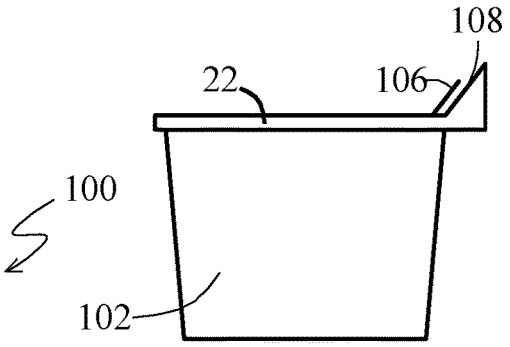
FIG. 19 shows the embodiment of FIG. 18, with the lid in the closed position.

Referring first to FIGS. 18 and 19, container 100 has lid 104 hinged to base 102 at 16. Lid 104 includes extension 106 which, in use, is inclined upwardly at an obtuse angle from lid 104.

Base 102 has rim 22 which has extension 108, in use inclined at an obtuse angle from rim 22.

In the closed position, extension 106 is designed to mate with extension 108. Extension 106 has one or more cut-outs, similar to those already illustrated in FIGS. 10 to 13 or 16 and 17, so that a flat label 60 applied to extension 106 will bind extension 106 to extension 108, exposed by the cut-out or cut-outs.

Figure 20:
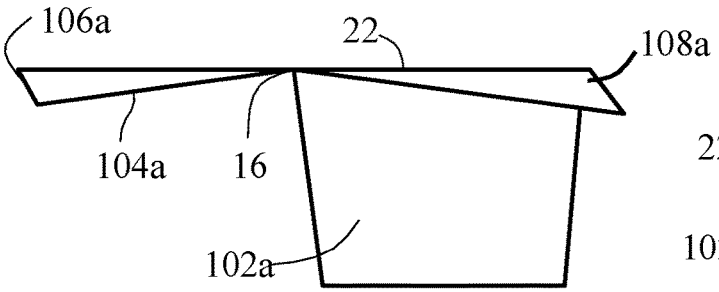
FIG. 20 is a side elevation of a further embodiment where the first and second planar areas are at an angle to the lid and base, showing the open position.
Figure 21:
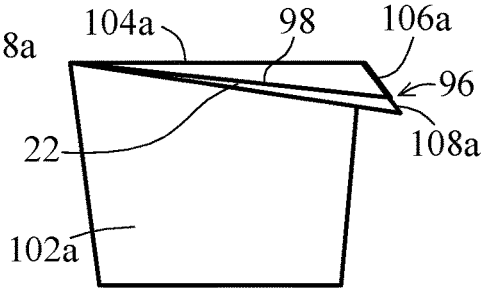
FIG. 21 shows the embodiment in FIG. 20 in the closed position.

The embodiment in FIGS. 20 and 21 is a variation of that in FIGS. 18 and 19 and the same labels will be used, with the addition of the letter "a". In this embodiment, lid **104*a* ends in flat portion 106*a*. Rim 22 on base 102*a* has a downwardly extending extension 108*a***.

In the closed position, extension **106*a* mates with extension 108*a* along margin 98 to provide a substantially co-planar surface 96 on which a label 60 (not shown) may be placed to seal lid 104*a* to base 102*a***.

It will be apparent to one skilled in the art that the embodiments in FIGS. 18 to 21 may be adapted to containers with separate lids. In that case, it is preferred that there are two extensions 106 (or **106*a*) and two extensions 108 (or 108*a***).

Figure 22:
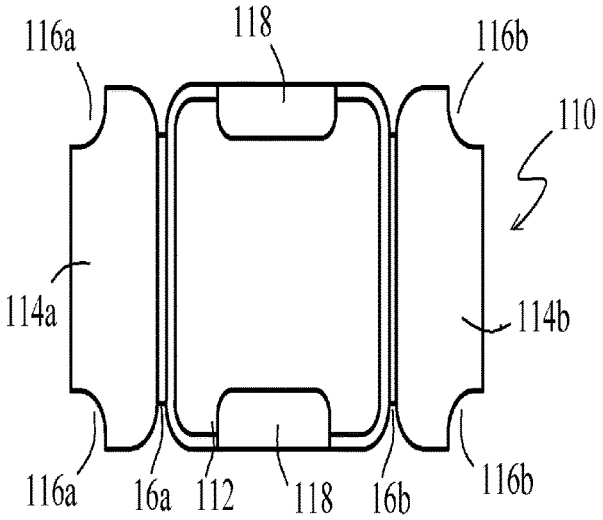
FIG. 22 is a top plan view of a further embodiment wherein the lid is in more than one part, showing the lid parts in the open position.
Figure 23:
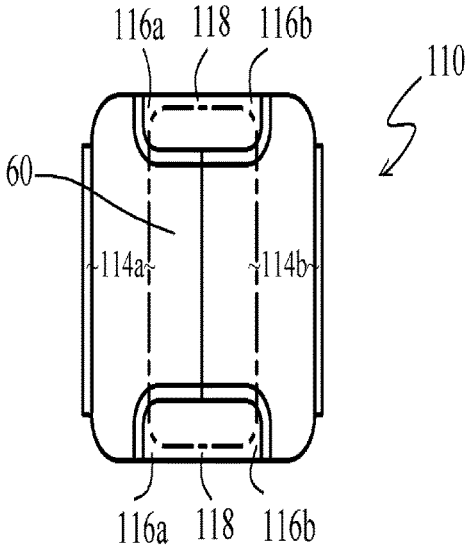
FIG. 23 shows the FIG. 22 embodiment with the lid parts in the closed position.

Reference is now made to the embodiment in FIGS. 22 and 23. In this embodiment, container 110 has base 112 as shown in FIG. 22. However, the lid is in two parts, 114*a* and 114*b*. Lid part 114*a* is hinged to base 112 at 16*a* while lid part 114*b* is hinged to base 112 at hinge 16*b*.

Each of lid parts 114*a* and 114*b* has a pair of cut-aways, 116*a* and 116*b*. When lid parts 114*a* and 114*b* are in the closed position as shown in FIG. 23, cut-aways 116*a* and 116*b* expose flat portions 118 on base 112. Lid parts 114*a* and 114*b* may meet or overlap in known manner, for example as described in Australian patent specification No 2003234951, the contents of which are incorporated herein by reference. Nevertheless, each of lid parts 114*a* and 114*b* provide a first planar area which is substantially co-planar with flat portion 118 on base 112. In this way, when lid parts 114*a* and 114*b* are in the closed position, label 60 can be applied on the substantially flat area so provided.

Figure 24:
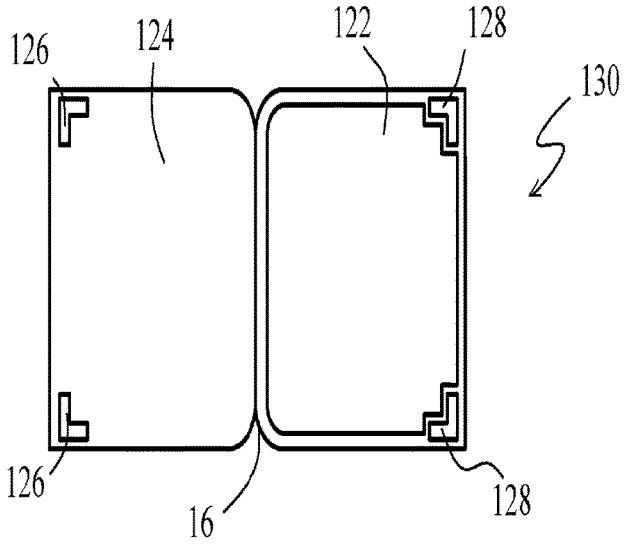
FIG. 24 is a top plan view of a further embodiment, showing the open position.
Figure 25:
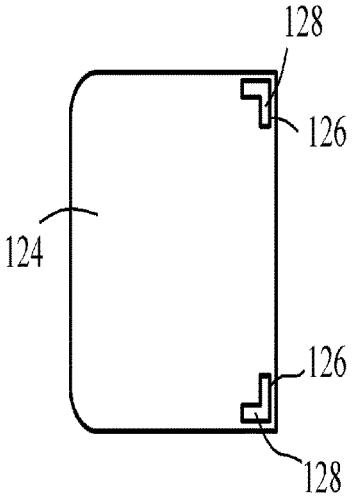
FIG. 25 shows the FIG. 24 embodiment in the closed position.

Referring now the embodiment in FIGS. 24 and 25, container 130 has base 122 hinged to lid 124 at hinge 16. Lid 124 has diecut holes 126. Lid 124 is generally flat to provide the first planar area.

Base 122 has formed sections 128, the top, flat part of which comprise the second planar areas. As can be seen by FIG. 25, in the closed position formed sections 128 mate with diecut holes 126 to form a substantially flat surface. A label (not shown) may be applied to cover both formed sections 128 and the intervening part of lid 124. Alternately, separate labels may be applied.

Figure 26:
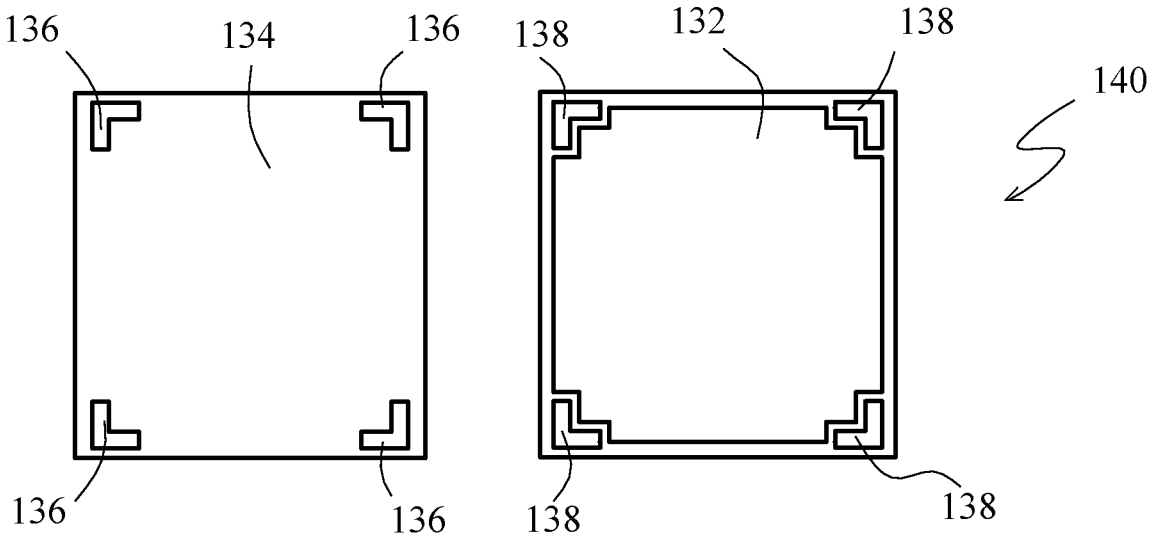
FIG. 26 shows yet a further embodiment, being a top plan view in the open position.
Figure 27:
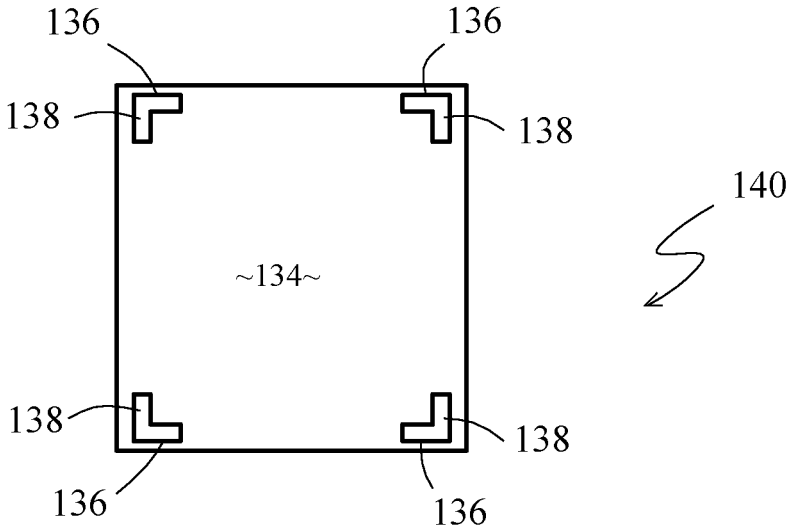
FIG. 27 shows the FIG. 26 embodiment in the closed position.

The embodiment in FIGS. 26 to 27 is similar to that in FIGS. 24 to 25; however, in container 140 in FIGS. 26 to 27, base 132 is separate from lid 134. In addition, there are four diecut holes 136 and correspondingly four formed sections 138. Like the embodiment in FIGS. 24 and 25, when lid 134 which is of the "outside fitting" type, is placed on base 132, sections 138 protrude into diecut holes 136 to provide a substantially flat area for label application.

It will be appreciated from the various embodiments described above that the container can be produced in a wide number of forms and that, in addition, a single form may be suitable for application of different types of labels. Lids may be hinged or separate.

Lids may be substantially flat or they may be shaped, with ridges, ribs, domes as non-limiting examples of shaping. Especially in the case of substantially flat lids, these may be designed to mate with the base so that the second planar area or areas can appear on, for example, opposing sides of the lid, opposing corners of the lid or on one side of the lid, opposite the hinge. In the case of a lid which is a dual lid, with two hinges, the second planar areas may be on two opposing sides (viewing the closed lid in plain view), or on four corners, for example.

In the case of a separate lid, once again viewing the container in plain view in the closed position, the second planar areas may be in each of four corners, on two opposing sides, on two diagonal corners, around all four sides or separately on each of four sides. These are a selection only of possible combinations. Others will be apparent to one skilled in the art.

INDUSTRIAL APPLICABILITY

The container can be adapted to any currently known container design, whether having a single lid or a multi-part lid. The embodiments allow for manual or high speed automatic closure and flat, self-adhesive label application providing tamper evidence, while at the same time employing a minimum number of moving parts.

The container can offer important tamper evidence capabilities while maintaining minimal obstruction of vision through the container lid. For certain applications, the container will also allow alternate graphic methods to be successfully used, such as pre-printing, branding and nutritional information onto the lid area, thus reducing label requirements to a smaller, basic tamper evident label only.

I claim:

1. A container comprising:

a lid and base constructed from a formable material;

the container having an open configuration and a substantially closed configuration wherein a cavity for containing contents within the container is defined between the lid and the base;

the lid having a substantially flat lid top area, a lock projection extending from a placement area, and the placement area is substantially planar and adapted for receipt of a membrane placed on the container, the placement area having a first surface area located on the lid and external to the cavity, and a coverable gap, void of the formable material, located adjacent to the first surface area;

the base having a floor area defining a substantially planar geometric plane and a rim portion including a base extension with a second surface area;

wherein a first portion of the membrane covers at least a part of the coverable gap and, a second portion of the membrane covers at least a part of the first surface area of the lid, and the lock projection is covered by, and projects away from, the membrane; and wherein, in the substantially closed configuration, the substantially flat lid top area is disposed substantially externally with respect to the cavity, disposed substantially parallel to the floor area of the base, facing away from the floor area, the placement area faces away from the substantially planar geometric plane, a lock receiver of the base contacts a section of the lock projection of the lid adjacent to the placement area to secure the lid to the base, a portion of the second surface area is within the coverable gap of the placement area and faces the membrane, the first portion of the membrane is substantially coplanar to the second portion of the membrane, and the first portion of the membrane covers the portion of the second surface area within the coverable gap.

2. The container of claim 1 wherein the placement area a has a plurality of geometric normal vectors oriented perpendicular to the placement area, and wherein, when the container is in substantially closed configuration, the plurality of geometric normal vectors are non-intersecting with the substantially planar geometric plane.

3. The container of claim 1 further comprising the lid having an additional lock projection extending from the placement area and the base having an additional lock receiver, wherein, in the substantially closed configuration,
the additional lock receiver of the base contacts the additional lock projection of the lid adjacent to the placement area to secure the lid to the base.

4. The container of claim 1 wherein
in the substantially closed configuration, the second surface area of the base extension is substantially coplanar with the first surface area of the lid.

5. The container of claim 1 wherein
the lid includes a third surface area oriented non-coplanar to the first surface area, and the membrane is directly secured to each of the first and third surface areas.

6. The container of claim 1 further comprising
the cavity having a lid portion and a base portion, wherein both the base portion and the lid portion are each individually configured to receive the contents, and
the cavity containing the contents, wherein the contents are selected from a group consisting of food stuffs and fresh produce.

7. The container of claim 1 further comprising
the lid and base rotatably coupled via a hinge;
wherein the base extension is in a fixed position relative to the hinge when the container is in both the open configuration and the substantially closed configuration.

8. The container of claim 1 wherein
a hole wholly disposed within the placement area of the lid defines the coverable gap.

9. The container of claim 1 wherein
the membrane includes an area of weakness in the first portion of the membrane and the area of weakness is adjacent to an edge of the coverable gap.

10. A container for containing contents for retail sale, the container comprising:
a lid, a base, and a label;
the label having a flat label portion;
the base and the lid both being constructed from a formable material having two substantially opposite surface sides defining a material thickness between the two substantially opposite surface sides;
wherein, the lid is moveable relative to the base about a hinge to transition the container between
a closed configuration and
an open configuration to facilitate access to the contents in an interior cavity within the container;
the base having
a floor area
defining a substantially planar geometric plane and configured to rest on a supportive flat surface area,
a sidewall extending from the floor area to a rim of the sidewall,
a base extension extending from the rim of the sidewall, and
the base extension having
an exposed surface area that is substantially flat and
a contact surface area orientated at an angle relative to the exposed surface area;
the lid having
a placement area adapted to receive the flat label portion,
the placement area including
a coverable gap substantially void of the formable material,
a first planar area having an edge with
a first edge part adjacent the coverable gap and
a second edge part adjacent a lid projection,
wherein
the coverable gap is disposed adjacent to the first planar area, and
the lid projection extending
at an angle from the first planar area and
away from the placement area,
wherein the lid projection extends from
a first surface point that is
on the lid,
adjacent to the second edge part,
bordered by the second edge part, and
more distant from the first edge part than the second edge part
to
a second surface point more distant from the flat label portion than the first surface point;
the flat label portion having
a display side,
an adhesive, and
an attachment side
located opposite the display side,
contacting the adhesive,
attached to the first planar area of the lid,
covering the first edge part of the edge of the first planar area,
covering and spanning across the coverable gap, and
substantially coplanar to the first planar area; and
wherein, when the container is in closed configuration,
the first planar area of the placement area is
external with respect to the interior cavity and
faces a general direction which is non-intersecting, with respect to the substantially planar geometric plane defined by the floor area,
the exposed surface area of the base extension is
adjacent the coverable gap,
oriented towards the attachment side of the flat label portion, and
substantially covering and spanning across the coverable gap, and
the lid projection is
covered by the flat label portion and
contacting the contact surface area of the base extension.

11. The container of claim 10 wherein
the first edge part is convex and
the second edge part is concave.

12. The container of claim 10 wherein
the first planar area has a plurality of geometric normal vectors oriented perpendicular to the first planar area, and
wherein, when the container is in the closed configuration,
the plurality of geometric normal vectors are
oriented away from the substantially planar geometric plane.

13. The container of claim 10 wherein
the lid has a flat lid top area,
the rim defines an opening of the base,
the label has a planar label portion secured to the flat lid top area,
wherein, in the closed configuration,
the flat lid top area is disposed parallel to the substantially planar geometric plane, and
wherein, in the open configuration,
the opening facilitates removal of the contents from a base portion of the interior cavity.

14. The container of claim 10 wherein
the contents contained within the container are fresh produce for retail sale.

15. The container of claim 10 wherein
the coverable gap is circumscribed by a lid hole wholly disposed within the first planar area.

16. The container of claim 10 wherein
the base has an opening opposite the floor area,
the lid has a second planar area that is disposed parallel to the substantially planar geometric plane when the container is in the closed configuration,
the lid has a third planar area adjacent to the hinge, and
the second planar area is located between the first planar area and the third planar area, and
wherein, in the open configuration, the opening of the base facilitates removal of the contents from a base portion of the interior cavity.

17. The container of claim 16 wherein
the label is directly secured to each of the first, second, and third planar areas of the lid.

18. The container of claim 16 wherein
the second planar area has a length and a width, and
the first planar area is separated from the third planar area by the width of the second planar area.

19. The container of claim 10 wherein
the base, lid, and hinge have a unitary construction of the formable material.

20. The container of claim 10 wherein
the base includes a plurality of ribs adapted hold the contents.

21. A container for containing a food product packaged within an interior cavity of the container for retail sale, the container comprising:
a lid
defining a lid portion of the interior cavity
having
a substantially planar lid surface and
a flat top surface of the lid located adjacent to the substantially planar lid surface;
a base defining a base portion of the interior cavity;
a lid lock
projecting
from a first edge of the substantially planar lid surface
to a contact point, and
wherein the lid lock projects from the first edge at an oblique angle relative to the substantially planar lid surface;
a base lock
configured to interact with the lid lock at the contact point to secure the container in a closed configuration;
an advertising membrane
adjacent
to the lid lock and
covering
the substantially planar lid surface,
the first edge of the substantially planar lid surface, and
the flat top surface of the lid;
wherein each of the lid, base, lid lock, and base lock are formed from a formable material;
wherein
the substantially planar lid surface defines and surrounds a gap in the formable material, and
a flat surface of the advertising membrane
covers the gap,
directly contacts the substantially planar lid surface, and
is adjacent to the contact point;
the base having
a floor having at least one substantially flat floor surface generally defined by a geometric plane,
a sidewall extending from the floor to a rim portion defining an opening of the base having a perimeter, wherein the opening is adapted to receive the food product into the base portion of the interior cavity,
wherein, the floor is configured to support the food product within the interior cavity; and
wherein, in the closed configuration,
the flat top surface of the lid and the floor of the base partially surround the interior cavity and
are configured to contain the food product therebetween,
the contact point of the lid lock is located outside the perimeter of the opening of the base, and
the substantially planar lid surface is
exterior to the interior cavity and
facing away from the geometric plane.

22. The container of claim 21 further comprising
a hinge joining the base to the lid, and
wherein the flat top surface of the lid is located between
the hinge and
the lid lock.

23. The container of claim 21 wherein
the substantially planar lid surface extends at an oblique angle
from, and with respect to, the flat top surface
to a second edge of the substantially planar lid surface.

24. The container of claim 21 wherein
the first edge of the substantially planar lid surface is planar and
fully surrounds the gap.

25. The container of claim 24 wherein
the base includes an exposed surface area oriented away from the opening of the base, and
in the closed configuration,
the exposed surface area is aligned with
a hole defining the gap and
the first edge of the substantially planar lid surface, and
the advertising membrane covers the exposed surface area.

26. The container of claim 25 wherein
a first surface of the formable material extends
from
an interior surface of the base partially defining the interior cavity
to
the exposed surface area of the base.

27. The container of claim 25 wherein
in the closed configuration, the exposed surface area is generally coplanar with the substantially planar lid surface.

28. The container of claim 25 wherein
the container includes the food product, and the food product is fresh produce.

29. The container of claim 25 wherein
in the closed configuration,
the flat top surface of the lid at least partially spans the perimeter of the opening of the base.

30. The container of claim 25 wherein
the substantially planar lid surface extends
from the flat top surface,
at an oblique angle with respect to the flat top surface,
to a second edge of the substantially planar lid surface.

31. The container of claim 21 wherein
in the closed configuration,
the flat top surface of the lid at least partially covers the opening of the base.

* * * * *